US007003969B2

(12) United States Patent
Powell et al.

(10) Patent No.: US 7,003,969 B2
(45) Date of Patent: Feb. 28, 2006

(54) CONDIMENT HOLDER

(75) Inventors: Brian C. Powell, Dover, DE (US); Dennis H. Clark, Camden, DE (US)

(73) Assignee: Metal Masters Foodservice Equipment Co., Inc., Clayton, DE (US)

( * ) Notice: Subject to any disclaimer, the term of this patent is extended or adjusted under 35 U.S.C. 154(b) by 0 days.

(21) Appl. No.: 11/153,167

(22) Filed: Jun. 15, 2005

(65) Prior Publication Data

US 2005/0230394 A1 Oct. 20, 2005

Related U.S. Application Data

(62) Division of application No. 10/616,648, filed on Jul. 10, 2003.

(51) Int. Cl.
*F25D 23/12* (2006.01)

(52) U.S. Cl. ..... 62/258; 62/457.5; 220/592.12

(58) Field of Classification Search ..... 62/258, 62/259.1, 457.5; 220/501, 509, 592.12, 592.13, 220/592.14, DIG. 2, 512; 211/74
See application file for complete search history.

(56) References Cited

U.S. PATENT DOCUMENTS

| | | | | |
|---|---|---|---|---|
| 531,067 | A | | 12/1894 | Savage |
| 966,258 | A | | 8/1910 | Sochurek |
| 2,248,467 | A | | 7/1941 | Scilken |
| 2,459,921 | A | | 1/1949 | Comer |
| 2,962,874 | A | | 12/1960 | Fitzgerald |
| 3,019,620 | A | | 2/1962 | Costantini et al. |
| 3,254,502 | A | | 6/1966 | Ellis |
| 3,379,315 | A | | 4/1968 | Broadwin |
| 3,555,848 | A | | 1/1971 | Johnson |
| 4,407,143 | A | | 10/1983 | Wolfe |
| 4,482,522 | A | | 11/1984 | Baudisch et al. |
| 4,870,835 | A | | 10/1989 | Wolfe et al. |
| 4,910,976 | A | * | 3/1990 | Drummond et al. ..... 62/457.5 |
| 4,923,086 | A | * | 5/1990 | Mahon et al. ..... 62/252 |
| 4,947,991 | A | | 8/1990 | Snell |
| 5,247,807 | A | | 9/1993 | Jarman et al. |
| 6,151,905 | A | | 11/2000 | Smith |
| 6,564,569 | B1 | * | 5/2003 | Havens ..... 62/258 |
| 6,802,802 | B1 | * | 10/2004 | Woog ..... 493/129 |
| 6,851,276 | B1 | * | 2/2005 | Perrins ..... 62/457.5 |

* cited by examiner

*Primary Examiner*—William E. Tapolcai
(74) *Attorney, Agent, or Firm*—Connolly Bove Lodge & Hutz LLP

(57) ABSTRACT

A condiment holder comprises a top having a plurality of spaced apart openings therein constructed and arranged to receive condiment containers. A partial enclosure is connected to and extends below the top. The enclosure includes a bottom wall generally parallel to the top, opposite upwardly extending end walls connected between the top and bottom walls, and front and back partial side walls that extend between lower portions of the end walls. At least one of the end and bottom walls has a plurality of air circulation openings therein to facilitate the flow of refrigerated air.

10 Claims, 1 Drawing Sheet

CONDIMENT HOLDER

CROSS-REFERENCE TO RELATED APPLICATION

The present application is a division of application Ser. No. 10/616,648, filed Jul. 10, 2003.

BACKGROUND OF THE INVENTION

The present invention relates to a condiment holder, and more particularly to a condiment holder having a formed top with a series of openings therein, sized to fit condiment containers, and a vented enclosure below the top which supports the containers while allowing refrigerated air to flow around the containers in the holder.

Refrigerated tables for use in the preparation of food are well known in the art. These tables are constructed with areas for holding ingredient storage pans or bins that are open to the air and easily accessible to food preparation personnel and direct consumers in the case of self service salad bars. Refrigerated tables are often equipped with work areas in close proximity to the refrigerated storage pans to provide the food preparation personnel spaces to prepare the food. These tables are generally used in restaurants, cafeterias, or by food service providers for the preparation of sandwiches, salads, etc.

In the preparation of food, it is common that many of the ingredients require refrigeration to a particular temperature to comply with health regulations as well as to improve the shelf life of the ingredients and the taste of the finished product.

Condiments such as ketchup, mustard, salad dressing, mayonnaise and the like are often dispensed from containers such as squeeze bottles, for example. Currently, when attempts are made to cool and maintain these bottles at desired temperature levels, operators may simply place the bottles on a bed of ice at or near the food processing table or counter top. This method is messy in that condensation collects on the counter top, and the bed of ice takes up valuable workspace.

Alternatively, an operator may use a ⅓ or ⅙ size steam table pan by placing the pan into an opening in the refrigerated table. This method allows only minimal cooling to occur since the condiment bottles never come in direct contact with the refrigerated air. Moreover, with no lid covering the pan, warm air from above enters the pan thereby defeating the refrigeration process.

SUMMARY OF THE INVENTION

Accordingly, one of the major objects of the present invention is a condiment holder for use with a refrigerated food processing table for maintaining condiment containers such as squeeze bottles at desired refrigerated temperature levels.

Another object of the present invention is a condiment holder which is simple in construction, but which cooperates with a refrigerated food processing table to maintain the condiment containers within the holder at desired refrigerated temperature levels.

In accordance with the present invention a condiment holder comprises a top having a plurality of spaced apart openings therein constructed and arranged to receive condiment containers. A partial enclosure is connected to and extends below the top. The enclosure includes a bottom wall generally parallel to the top, opposite upwardly extending end walls connected between the top and bottom walls, and front and back partial side walls that extend between lower portions of the end walls. At least one of the end and bottom walls has a plurality of air circulation openings therein.

In a preferred embodiment of the present invention, the bottom and both end walls have a plurality of air circulation openings herein and the openings are generally circular in configuration. Moreover, the partial side walls that extend between lower portions of the end walls are connected to the bottom wall of the partial enclosure.

The spaced apart openings in the top are circular, and in one embodiment of the present invention eight openings are provided while in another embodiment four openings are provided. Preferably the top includes a peripheral lip outwardly extending from the end walls as well as the front and back partial side walls.

The present invention also includes the condiment holder in combination with a plurality of condiment containers within at least some of the spaced apart openings in the top. The condiment containers may be squeeze bottles each having a circular cross section that fits within circular openings in the top.

BRIEF DESCRIPTION OF THE DRAWINGS

Novel features and advantages of the present invention in addition to those mentioned above will be readily apparent to persons of ordinary skill in the art from a reading of the following detailed description in conjunction with the accompanying drawings wherein similar reference characters refer to similar parts and in which.

DETAILED DESCRIPTION OF THE INVENTION

Figure 1:
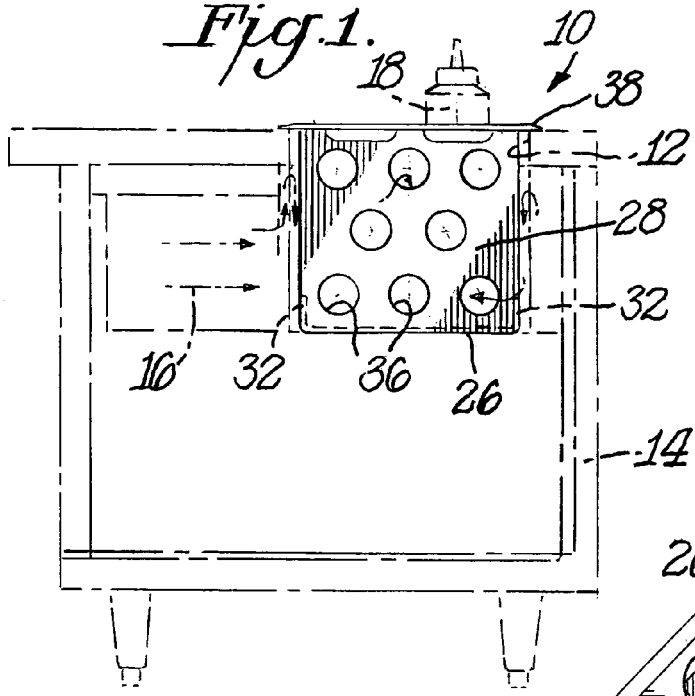
FIG. 1 is an end elevational view of a condiment holder, according to the present invention, with the holder positioned within the refrigerated compartment of a food preparation table shown in phantom outline.
Figure 2:
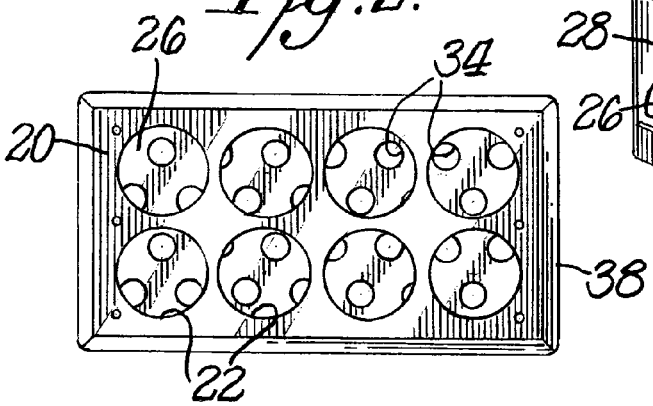
FIG. 2 is a top plan view of the condiment holder shown in FIG. 1.
Figure 3:
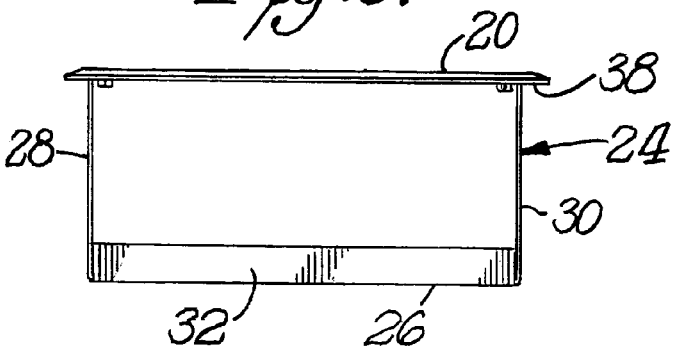
FIG. 3 is a side elevational view of the condiment holder shown in FIGS. 1 and 2.

Referring in more particularity to the drawing, FIGS. 1–3 illustrate a condiment holder 10 having an overall size that fits within the top opening 12 of a refrigerated food preparation table 14. Tables of this type are well known, and one such table is described in U.S. Pat. No. 6,151,905, incorporated herein by reference. As explained more fully below, when the condiment holder 10 is so positioned within the opening 12, refrigerated air 16 circulates in, around and through the holder to thereby maintain condiment containers 18 within the holder at desired temperature levels.

Condiment holder 10 includes a top 20 having a plurality of spaced apart openings 22 therein constructed and arranged to receive the condiment containers 18. A partial enclosure 24 is connected to and extends below the top 20. The enclosure includes a bottom wall 26 spaced from and generally parallel to the top 20, as illustrated in the drawing. The partial enclosure 24 also includes opposite upwardly extending end walls 28, 30 connected between the top 20 and the bottom wall 26. Additionally, front and back partial side walls 32 extend between lower portions of the end walls 28, 30, as shown best in FIG. 3.

Preferably the bottom wall 26 includes a plurality of air circulation openings 34 for the purposes of allowing refrigerated air 16 to flow through the condiment holder 10. Similarly, the end walls 28, 30 also include a plurality of air circulation openings 36 which allow the flow of refrigerated air 16 in and through the condiment holder.

The partial side walls 32 extending between the lower portions of end walls 28, 30 are also connected to the bottom wall 26 of the partial enclosure 24. The partial side walls 32 extend upwardly from the bottom wall, as shown best in FIG. 3.

Additionally, a peripheral lip 38 extends outwardly from the end walls 28, 30 and also outwardly from the profile of the front and back partial sides walls 32. The lip 38 engages the top of the refrigerated food processing table 14 upon insertion into the opening 12.

The openings 22 in the top 20 preferably are circular in configuration, as shown in FIG. 2. In this embodiment of the present invention eight circular openings 22 are provided in the top 20 for holding a maximum of eight condiment containers 18.

The condiment holder 10 preferably is fabricated from sheet metal material although other materials are equally suitable. Also, the condiment containers 18 preferably are squeeze bottles, each having a circular cross section in the transverse direction.

Figure 4:
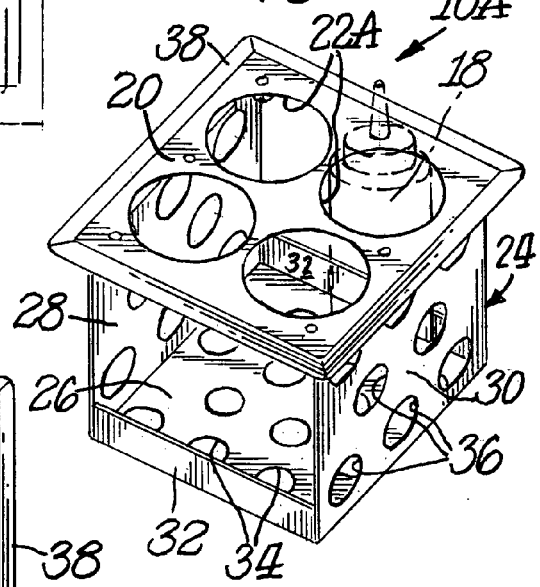
FIG. 4 is a perspective view of another condiment holder, according to the present invention.

FIG. 4 illustrates another embodiment of the present invention comprising of condiment holder 10A. Fundamentally, the only significant difference between the condiment holder 10A is that it includes four circular openings 22A in the top 20 for holding a maximum of four condiment containers 18. Otherwise, the structural details of condiment holder 10A are the same as holder 10, and similar reference characters are used to identify similar parts.

In operation, the condiment holders 10, 10A are placed within suitably dimensioned openings 12 in the refrigerated food processing table 14. The condiment containers 18 are placed within the openings 22, 22A, and refrigerated air 16 circulates in, around and through the condiment holders via the circulation openings 34 in the bottom walls 26 and the circulation openings 36 in the end walls 28, 30. Additionally, refrigerated air flows through the open side spaces above the partial side walls 32.

What is claimed is:

1. A condiment holder in combination with a refrigerated table having an opening therein constructed and arranged to receive the condiment holder, the holder comprising a top having a plurality of spaced apart openings therein constructed and arranged to receive condiment containers, a peripheral lip on the holder engaging the refrigerated table at the opening therein, a partial enclosure connected to and extending below the top, the enclosure including a bottom wall generally parallel to the top, opposite upwardly extending end walls connected between the top and the bottom wall of the enclosure, front and back partial side walls extending between lower portions of the end walls, at least one of the end and bottom walls having a plurality of air circulation openings therein, and a plurality of condiment containers within at least some of the spaced apart openings in the top.

2. A condiment holder as in claim 1 wherein the bottom wall and both end walls have a plurality of air circulating openings therein.

3. A condiment holder as in claim 2 wherein the air circulating openings are circular.

4. A condiment holder as in claim 1 wherein each of the partial sidewalls is connected to the bottom wall of the partial enclosure.

5. A condiment holder as in claim 1 wherein each of the spaced apart openings in the top are circular.

6. A condiment holder as in claim 5 wherein the circular spaced apart openings comprise eight openings.

7. A condiment holder as in claim 5 wherein the circular spaced apart openings comprise four openings.

8. A condiment holder as in claim 1 wherein the top and partial enclosure are sheet metal.

9. The combination of claim 1 wherein the condiment containers are squeeze bottles.

10. The combination of claim 9 wherein the spaced apart openings in the top are circular, and the squeeze bottles each have a circular cross section in a transverse direction.

* * * * *